United States Patent [19]

Trainor, Jr. et al.

[11] Patent Number: 5,069,010

[45] Date of Patent: Dec. 3, 1991

[54] GLASS DOOR OR PARTITION SUPPORT RAIL

[75] Inventors: Robert J. Trainor, Jr., Orland Park, Ill.; Samuel B. Bardo, Bristol, Ind.; David A. Leonard, Lynwood, Ill.

[73] Assignee: Doralco, Inc., Alsip, Ill.

[21] Appl. No.: 607,888

[22] Filed: Nov. 1, 1990

[51] Int. Cl.[5] ..... E04B 1/60

[52] U.S. Cl. ..... 52/127.8; 52/825

[58] Field of Search ..... 52/127.8, 825, 826, 52/204, 475

[56] References Cited

U.S. PATENT DOCUMENTS

| | | | |
|---|---|---|---|
| 3,789,564 | 2/1974 | Kessler | 52/475 |
| 4,235,049 | 11/1980 | Marinoni | 52/825 |
| 4,655,025 | 4/1987 | Marinoni | 52/825 |

*Primary Examiner*—David A. Scherbel
*Assistant Examiner*—W. Wood

[57] ABSTRACT

A support rail for mounting panels of glass or the like to be used as doors or partitions or the like, which comprises a longitudinally extending female rail section defining an outward direction and an inward direction and having an inwardly extending female flange portion, an inwardly facing sidewall extending vertically above the female flange portion, a vertical mounting section extending below the female flange portion, and an upper mounting surface extending transversely outwardly from the top of the sidewall; a longitudinally extending male rail section defining an outward direction and an inward direction corresponding to the inward direction of the female rail section and having an inwardly extending male flange portion, an inwardly facing sidewall extending vertically above the male flange portion, a vertical mounting section extending below the male flange portion, and an upper mounting surface extending transversely outwardly from the top of the sidewall; adjustable fastening means for connecting the female rail section and the male rail section through the female and male flange portions; a lower accessory channel defined by the male and female flange portions and the vertical mounting sections; an upper channel defined by the male and female flange portions and the sidewalls for receiving the edge of a panel of glass or the like; and longitudinally extending side cover members fixedly attachable to the upper mounting section and the vertical mounting section of the rail sections.

10 Claims, 2 Drawing Sheets

GLASS DOOR OR PARTITION SUPPORT RAIL

FIELD OF THE INVENTION

This invention relates to a rail or frame element used to support a pane or panel of glass so that it can be used as a door or partition. More particularly, the invention relates to support rails which attach to the top and the bottom of a glass panel to enable the glass panel to be mounted within a door frame or the like.

BACKGROUND OF THE INVENTION

Glass panels are widely used as doors and partitions in a variety of commercial and business settings. A popular way of mounting glass panels as doors or partitions employs support rails or similar frame elements which attach to only the top and bottom edges of the glass panel. This method eliminates the need for vertical side frame elements and thus permits an unobstructed view through a series of contiguous glass panels. Individual support rails are assembled onto the top and bottom extremes of the glass panels and allow the panels to be mounted to either the floor and ceiling if the panel is to be used as a partition or wall, or appropriate door frame means if the glass panel is to be used as a door.

The assembly of the support rail with the glass panel is traditionally performed by the glass temperer or glazier Previously, this assembly was accomplished using a "wet glazing" method, wherein the edge of the glass panel is placed in a U-shaped channel in the support rail and the remainder of the channel is filled with cement This process is necessarily difficult, time consuming and somewhat permanent. Recent developments in support rails have allowed for a "dry glazing" process, whereby the glass panel is secured to the support rail mechanically, using screws or similar clamping means. While these newer support rails can be adjusted and removed prior to and even after final assembly, the clamping mechanisms are relatively involved and the support rails accordingly difficult and time consuming to assemble. In addition, many support rails are designed to accommodate a single mounting arrangement. Since different installation specifications may require variations in the placement of the mounting elements, for example, the door closure means, the pivot element and the lock assembly, these existing support rails may be unusable in certain installations. Therefore, it is desirable to provide a support rail which is versatile enough to be used in a wide variety of installations. It is also desirable to provide such a support rail that is simple and quick to assemble.

An existing support rail device is shown in U.S. Pat. No. 4,655,025 to Marinoni, which discloses an edge rail for of differing lengths which must be interconnected by way of a flanged lock. Each of these rail sections, in turn, is comprised of two rail members which are attached to one another by way of transverse screws and which define two clamping jaws between which the glass panel is held when the transverse screws are tightened. Marinoni's rail further comprises two cover strips or side shrouds which, due to the placement of the transverse screws, can only be attached after the rail members are assembled with and clamped to the glass panel. Moreover, future maintenance of the support rail requiring access to the transverse screws would require detachment of the cover strips from the rail members.

Another prior art support rail device is disclosed in U.S. Pat. No. 4,680,903 to Horgan, Jr., which shows a metal frame for a glass door comprising a longitudinally extending shoe member having an H-shaped cross section forming an upper channel into which the edge of a glass panel is received, a strip of double-faced tape along one side surface of the upper channel, and a number of pressure units in spaced apart relation to one another along the other side surface of the upper channel for securing the glass panel within the channel of the door shoe. Thus during assembly, the pressure units must be positioned within the channel of the shoe member and loosely held in place while the glass panel is aligned within the channel and squared with the shoe member. Then the glass panel must be removed so that the protective cover of the double-faced tape can be removed. Finally, the glass panel must be replaced and the screws within the pressure units advanced to secure the glass panel within the channel. The pressure units, moreover, only engage the glass panel at discrete locations along the length of the shoe member.

Existing support rails are commonly made of metal, which increases the weight of these rails and requires sturdier frame members to accommodate the glass panel and support rail assembly. Moreover, attempts to reduce the amount of metal used have resulted in support rail elements having complicated exterior side profiles which make the manufacture of the support rail and attachment of side shrouds difficult and involved. In addition, slight variations in the thickness of a panel of glass can create difficulty in clamping the support rail to the glass and cause stress points to exist in the glass once it is clamped within the rail. Furthermore, repeated use of a glass door comprised of a rail support and a glass panel may result in the glass panel dislodging from the rail support.

SUMMARY OF THE INVENTION

Therefore, it is an object of the present invention to provide a support rail for mounting glass doors and partitions which has a relatively simple construction and is easy to manufacture and both lightweight and sturdy.

It is another object of the present invention to provide a support rail which can be readily and efficiently installed and, if necessary, sized to accommodate various mounting specifications. A further object is to provide a support rail which provides continuous horizontal support at the edge of the glass panel and which resists the tendency of the glass panel to pull away from the rail. Another object of the present invention is to provide a support rail assembly which allows the side cladding to be permanently affixed while at the same time providing access to the clamping means.

According to the present invention, these and other objects are achieved by providing a support rail assembly comprising a longitudinally extending male rail section, a longitudinally extending female rail section, clamping means transverse of the male and female rail sections, and longitudinally extending side cladding members. The male and female rail sections are manufactured as extrusions and are thus easy to manufacture. The male rail section has a longitudinal flange which engages a corresponding set of longitudinal flanges on the female rail section. The male and female rail sections are held together by screws extending through the web separating the flanges of the female rail section and into the flange of the male rail section. These screws also act as the adjustable fastening and clamping means. When the male and female rail sections are assembled, they form a rail member having a generally H-shaped section, i.e., the engaging flanges define an upper channel and a lower accessory channel. The side walls of the upper channel are defined by the upper portions of the male and female sections and have ribbed profiles to engage strips of rubber or similar material. The side cladding members are simple, longitudinally extending L-shaped members which are attached to the exterior surfaces of the male and female rail sections by an adhesive or any suitable means. The female rail section has cut-aways proximate each screw so that the screws can be accessed from the lower accessory chamber to allow the clamping means to be engaged or disengaged while the entire support rail is assembled.

Thus, to assemble a panel of glass with the support rail, the support rail is simply placed over the upper or lower edge of the panel and the screws advanced by means of a wrench. Since the screws extend through the web separating the flanges of the female rail section and into the flange of the male rail section, the entire lengths of both rail sections are brought into contact with the edge of the glass panel, thus providing continuous horizontal support for the glass panel along its edge. The ribbed surfaces of the side walls of the upper channel engage the rubber strip and resist the tendency of the glass panel and rubber strip to be pulled out of the upper channel. In addition, the overlapping flanges of the male and female rail sections allow the support rail to expand while still maintaining engagement of the male and female rail sections to accommodate the variations in thickness that may be present in a given panel of glass. Furthermore, since the support rail comes preassembled, i.e., with the cladding and clamping means already attached, the rail can be easily assembled with the glass panel in a minimum amount of time. The lower accessory channel provides a uniform area for mounting various frame elements in any of a number of locations.

These and other objects and advantages of the present invention will be made apparent from the following detailed description, with reference to the accompanying drawings.

DETAILED DESCRIPTION OF THE PREFERRED EMBODIMENT

Figure 1:
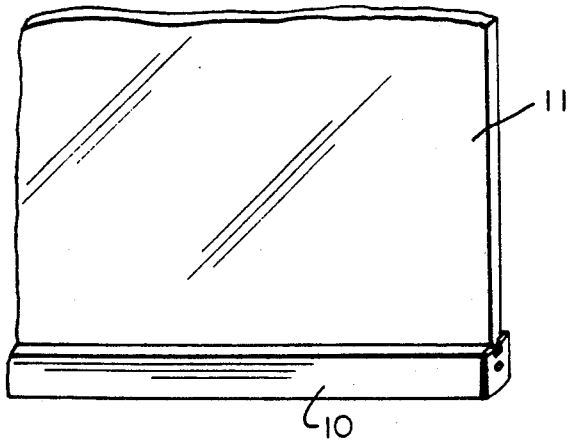
FIG. 1 is a partial perspective view of the support rail of the present invention assembled on the bottom edge of a panel of glass.

Referring to FIG. 1, an elongated support rail 10 is shown connected to the bottom edge of a pane or panel of glass 11. Support rail 10 extends substantially the entire width of glass panel 11 and is attached to the edge of glass panel 11 by clamping means to be described below. It is to be understood that support rail 10 need not extend the entire width of glass panel 11 and that a corresponding support rail (not shown) may be attached to the top edge of glass panel 11 so that the entire assembly can be mounted in a suitable frame (not shown) to enable panel 11 to act as either a door or a partition.

Figure 2:
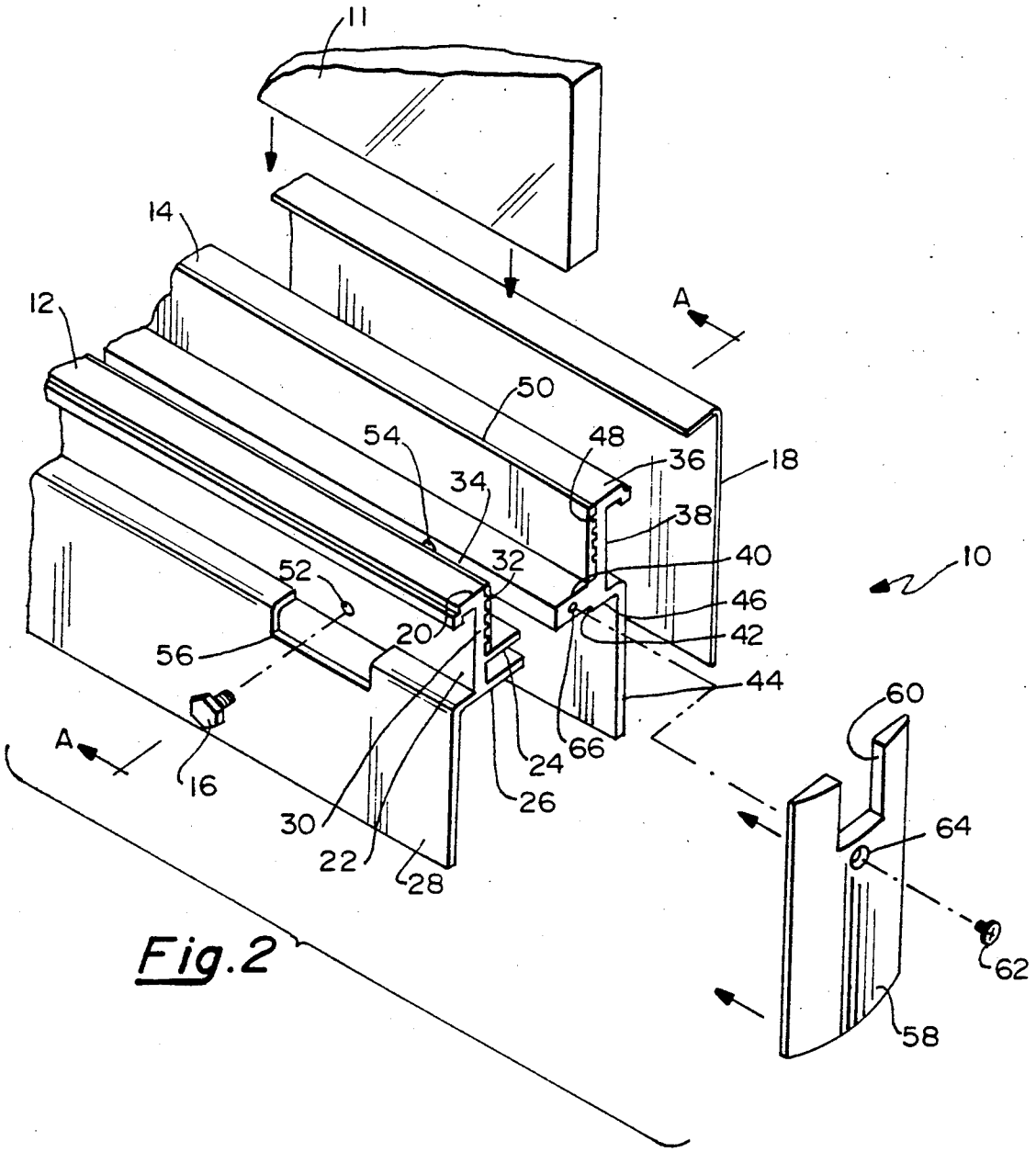
FIG. 2 is an exploded isometric view of the end portion of the support rail.

Referring to FIG. 2, which depicts an end section of support rail 10, support rail 10 is comprised of a longitudinally extending female rail section 12, a longitudinally extending male rail section 14, a plurality of screws or adjustable fastening or clamping means 16 transverse to rail sections 12 and 14, and a pair of longitudinally extending side cladding members or rail cover members 18, only the right one of which is shown in FIG. 2. Rail sections 12 and 14 define an inner location or direction between these sections and an outer location and direction.

Female rail section 12 has an upper mounting section 20, a sidewall 22 extending vertically downwardly therefrom, a horizontal upper female flange 24 extending transversely from sidewall 22 a distance below upper mounting section 20, a horizontal lower female flange 26 extending transversely from the bottom of sidewall 22 a distance below upper flange 24, and a lower, vertical mounting section 28 extending downwardly from the outer extreme of lower flange 26. The inner facing surface of the upper portion 30 of sidewall 22 above upper flange 24 is preferably imparted with a number of longitudinally extending, parallel ribs 32, which provide a frictional mounting surface for a strip or gasket 34 extending over the entire inner facing surface of upper portion 30 of sidewall 22. Gasket 34 is made of a flexible, elastomeric material, such as rubber.

Male rail section 14 comprises an upper mounting section 36 identical to upper mounting section 20 of female rail section 12, a sidewall 38 extending vertically downwardly therefrom, a central male flange 40 extending transversely inwardly from sidewall 38 a distance below mounting section 36, which corresponds to the vertical distance from mounting section 20 to the portion of sidewall 22 between upper flange 24 and lower flange 26 of female rail section 12, a shoulder 42 defined by the portion of sidewall 38 between the bottom of flange 40 and the bottom of sidewall 38, and a vertical mounting section 44 similar to mounting section 28 extending downwardly from a horizontal section 46 of male rail section 14 adjacent shoulder 42. Rail section 14 is also provided with a number of ribs or ridges 48 on the inner facing surface of sidewall 38 which provide a frictional mounting surface for a gasket 50 identical to gasket 34 on female rail section 12.

As can readily be seen from FIG. 2, rail sections 12 and 14 have generally uniformly thin cross sections. This allows these members to be manufactured by extrusion, thus eliminating the need to machine separate lengths of sections 12 and 14 individually, which can be costly and time consuming. In addition, because of the sturdiness inherent in their rectangular profiles, rail sections 12 and 14 can be made of a relatively lightweight metal, such as aluminum. The use of a lightweight metal for rail sections 12 and 14 necessarily reduces the weight of support rail 10 and the door or partition assembly.

Figure 3:
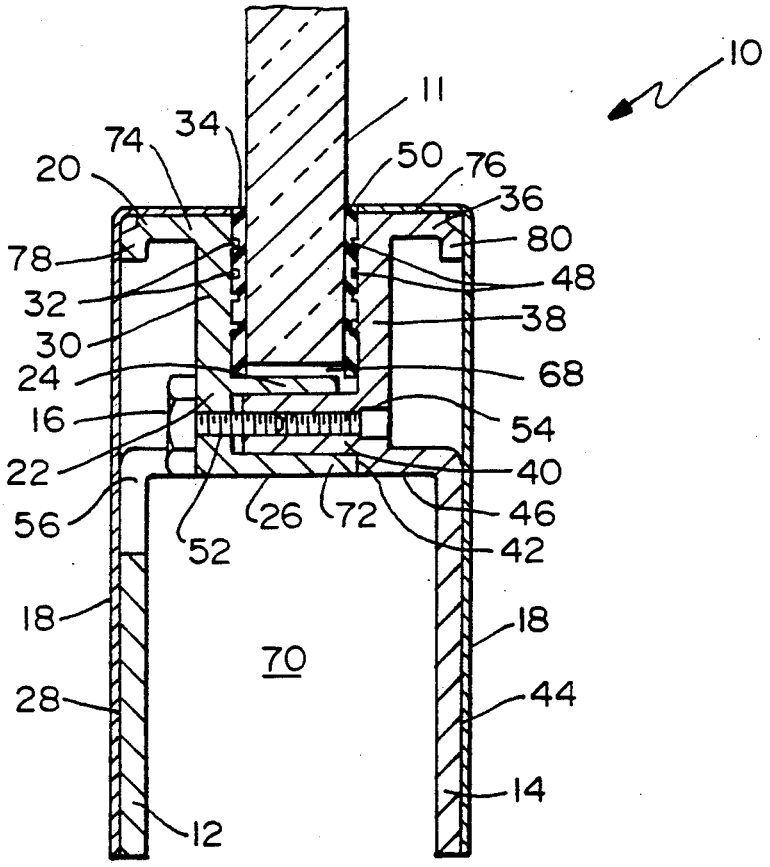
FIG. 3 is a cross-sectional view of the assembled support rail taken along line A—A of FIG. 2.

Referring to FIG. 3, female rail section 12 and male rail section 14 are connected by way of their flanges. Central flange 40 of male rail section 14 is positioned between upper flange 24 and lower flange 26 of female rail section 12. The fit between central flange 40 and upper and lower flanges 24, 26 is loose enough to allow for a slight pivotable movement of female rail section 12 about male rail section 14, as will be described below. The rail sections are held together by way of a number of screws 16, or any other appropriate adjustable securing means, spaced along the length of support rail 10 at appropriate intervals. For example, a thirty-six inch support rail 10 may employ six screws 16 spaced at approximately six-inch intervals, beginning approximately two to three inches from one end of support rail 10. Referring again to FIG. 2, female rail section 12 is provided with a number of holes 52 corresponding to the number of screws 16. Holes 52 extend transversely through the portion of sidewall 22 between upper flange 24 and lower flange 26 of female rail section 12. A number of corresponding holes 54 extend transversely through the central portion of central flange 40 of male rail section 14. Holes 54 are threaded to receive screws 16, which extend through holes 52 and into holes 54 to thereby fasten rail section 12 to rail section 14 (FIG. 3). Female rail section 12 comprises an opening or adjustment access port 56 adjacent each hole 52 where lower flange 26 adjoins vertical mounting section 28 to allow access to screws 16 from below lower flange 26 when cladding 18 is attached to the outer surface of rail section 12, as is seen by reference to FIG. 3.

Each end of support rail 10 may be provided with an end cap 58. End cap 58 is relieved along its upper surface as at 60 to allow the glass panel 11 to protrude beyond the ends of support rail 10, if necessary. Relieved portion 60 also allows for visual confirmation that support rail 10 is properly assembled with glass panel 11. End plate 58 is attached to support rail 10 by any convenient means, such as screw 62, which fits through countersunk hole 64 in end plate 58 and into a corresponding threaded hole 66 that extends longitudinally into central flange 40 of male rail section 14.

Referring again to FIG. 3, female rail section 12 and male rail section 14 define an upper mounting channel 68 and a lower accessory channel 70. The bottom of the upper channel 68 is defined by upper flange 24 of female rail section 12 and the upper surface of central flange 40 of male rail section 14. Sidewall 38 of male rail section 14 and the upper portion 30 of sidewall 22 define the sidewalls of channel 68. Glass panel 11 is assembled with support rail 10 by placing panel 11 into channel 68 between gaskets 34, 50. Screws 16 are preferably advanced by means of a pre-set torque wrench or other appropriate means (not shown) to pull male rail section 14 into female rail section 12, thereby bringing sidewalls 30 and 38 and their corresponding gaskets 34, 50 into engagement with glass panel 11.

As can best be seen by reference to FIG. 3, lower flange 26 of female rail section 12 extends transversely inwardly a greater degree than does upper flange 24. When female rail section 12 is assembled with male rail section 14, end 72 of lower flange 26 will abut shoulder 42 of male rail section 14 and thereby define the width of channel 68 as being slightly greater than the thickness of glass panel 11. Since the end of upper flange 24 is not long enough to engage sidewall 38 of male rail section 14, tightening of screw 16 will cause rail sections 12, 14 to pivot about end 72, thereby causing sidewalls 30 and 38 of channel 68 to rotate slightly inwardly to ensure a firm clamping of glass panel 11 within channel 68.

Additionally, upper flange 24 and lower flange 26 overlap central flange 40 a significant amount. This overlap enhances the strength of support rail 10 and allows rail sections 12 and 14 to be separated a certain distance before flanges 24, 26 and 40 disengage. Therefore, upper channel 68 can be expanded to accommodate the variations in thickness of a glass panel while flanges 24, 26 and 40 are maintained in engagement, thereby preserving the structural integrity of support rail 10.

Gaskets 34 and 50, positioned on sidewalls 30 and 38, respectively, also help account for the various fluctuations of thickness that may be present in a given glass panel. In addition, gaskets 34, 50 engage ribs 32 and 48 on sidewalls 30 and 38, respectively. The interaction of ribs 32, 48 with gaskets 34, 50 holds glass panel 11 firmly against forces tending to pull panel 11 out of channel 68. Screws 16 connect rail sections 12, 14 at spaced intervals along the length of support rail 10 to provide a uniform horizontal clamping force along the entire lower extremity of glass panel 11. Therefore, support rail 10 can be provided in any desired length without a loss of clamping force at any location along the edge of the glass panel engaged by support rail 10.

Still referring to FIG. 3, accessory channel 70 is defined by vertical mounting sections 28, 44 and the bottom surfaces of lower flange 26 and horizontal section 46. Accessory channel 70 may be used to mount a door closure member, lock assembly, hinge, or other mounting structure (not shown) required to mount the glass and rail assembly in a door or other frame. This structure can be mounted either to the upper horizontal surface defined by flange 26 and horizontal section 24, or to one or both vertical mounting sections 28, 44 by any known means. Thus, support rail 10 can be used with different installation specifications by simply varying the location of the mounting structure within channel 70. Vertical mounting sections 28, 44 extend sufficiently to house such structure once it is mounted within channel 70.

Longitudinally extending side cladding or cover members 18 extend over the exterior side surfaces of rail sections 12, 14 to provide support rail 10 with a clean, finished appearance. Cladding members 18 are mounted to respective upper mounting sections 20, 36 and vertical mounting sections 28, 44 by an adhesive or any suitable means. Upper mounting sections 20, 36 comprise horizontal sections 74, 76 and vertical sections 78, 80, respectively. Vertical sections 78, 80 are spaced apart from sidewalls 22 and 38 in alignment with vertical mounting sections 28, 44, respectively. Vertical sections 78, 80 and vertical mounting surfaces 28, 44 provide the lateral support required for cladding members 18 to be mounted to rail sections 12, 14 and thereby eliminate the need for superfluous material between cladding 18 and sidewalls 30, 38, thus reducing the weight and cost of support rail 10.

It should be recognized that, while the present invention has been described in relation to the preferred embodiment thereof, those skilled in the art may develop a wide variation of structural details without departing from the principles of the invention. Therefore, the appended claims are to be construed to cover all equivalents falling within the true scope and spirit of the invention.

What is claimed is:

1. A support rail for mounting panels of glass or the like to be used as doors or partitions or the like, which comprises:

(a) a longitudinally extending female rail section defining an outward direction and an inward direction and having an inwardly extending female flange portion, an inwardly facing sidewall extending vertically above said female flange portion, a vertical mounting section extending below said female flange portion, and an upper mounting surface extending transversely outwardly from the top of said sidewall;

(b) a longitudinally extending male rail section defining an outward direction and an inward direction corresponding to said inward direction of said female rail section and having an inwardly extending male flange portion, an inwardly facing sidewall extending vertically above said male flange portion, a vertical mounting section extending below said male flange portion, and an upper mounting surface extending transversely outwardly from the top of said sidewall;

(c) adjustable fastening means for connecting said female rail section and said male rail section through said female and male flange portions;

(d) a lower accessory channel defined by said male and female flange portions and said vertical mounting sections;

(e) an upper channel defined by said male and female flange portions and said sidewalls for receiving the edge of a panel of glass or the like; and (f) longitudinally extending side cover members fixedly attachable to the upper mounting section and the vertical mounting section of said rail sections.

2. The support rail of claim 1, wherein said female flange portion comprises an upper flange and a generally parallel lower flange and said male flange portion is positioned between said upper flange and said lower flange so that said upper and lower flanges overlap said male flange portion.

3. The support rail of claim 1, further comprising a plurality of longitudinally extending, generally parallel ribs on each of said inwardly facing sidewalls, and an elastomeric gasket extending longitudinally along each of said sidewalls, wherein said gaskets engage said edge of said glass panel and interact with said ribs to resist the tendency of said glass panel to be pulled out of said upper channel.

4. The support rail of claim 2, wherein said fastening means comprises a plurality of screws, each of which having a head and a threaded shank, in spaced apart relation along the length of said support rail extending inwardly transversely through the portion of said sidewall between said upper and lower flanges of said female rail section and into the male flange of said male rail section, whereby advancement of said screws causes said female rail section and said male rail section to be drawn together to thereby clamp said panel of glass between said sidewalls of said upper channel along the entire width of said panel of glass.

5. The support rail of claim 4, wherein said upper and lower flanges overlap said male flange to such an extent that said screws can be retreated to allow said sidewalls to expand to accommodate the varying thickness of a panel of glass while said upper and lower flanges maintain engagement with said male flange to thereby retain the structural integrity of said support rail.

6. The support rail of claim 4, wherein said female rail section further comprises an access port adjacent each fastening means to allow the heads of said screws to be accessed from said lower accessory channel while said side cover members are attached to said male and female rail sections.

7. The support rail of claim 4, wherein said male rail section comprises a shoulder extending below said male flange portion, and said lower flange is longer than said upper flange, whereby advancement of said screws brings the end of said lower flange into engagement with said shoulder to cause said male rail section to pivot about said female rail section at said end of said lower flange, thereby further increasing the clamping force of said upper sidewalls.

8. The support rail of claim 1, wherein said female rail section and said male rail section comprise generally uniformly thin cross sections.

9. A support rail for mounting panels of glass or the like to be used as doors or partitions or the like, which comprises:

(a) a longitudinally extending female rail section defining an outward direction and an inward direction and having an inwardly extending female flange portion, an inwardly facing sidewall extending vertically above said female flange portion, and a vertical mounting section extending below said female flange portion;

(b) a longitudinally extending male rail section defining an outward direction and an inward direction corresponding to said inward direction of said female rail section and having an inwardly extending male flange portion, and inwardly facing sidewall extending vertically above said male flange portion, and a vertical mounting section extending below said male flange portion;

(c) adjustable fastening means for connecting said female rail section and said male rail section through said female and male flange portions;

(d) a lower accessory channel defined by said vertical mounting sections;

(e) an upper channel defined by said male and female flange portions and said sidewalls for receiving the edge of a panel of glass or the like; and (f) access means for permitting said fastening means to be actuated from said lower accessory channel.

10. The support rail of claim 9, wherein said adjustable fastening means are screws spaced along substantially the entire length of said support rail to clamp said panel of glass between said inwardly facing sidewalls along substantially the entire width of said panel of glass within said upper channel.

* * * * *